United States Patent [19]

Hart et al.

[11] 3,942,304

[45] Mar. 9, 1976

[54] PACKAGING APPARATUS

[75] Inventors: Charles G. Hart; Richard H. Cochrane, both of Sheboygan; Harvey Heiner, New Holstein, all of Wis.

[73] Assignee: Hayssen Manufacturing Company, Sheboygan, Wis.

[22] Filed: Mar. 24, 1975

[21] Appl. No.: 561,547

[52] U.S. Cl. ..... 53/182 R

[51] Int. Cl.[2] ..... B65B 51/26; B65B 9/06

[58] Field of Search ..... 53/180 R, 182 R

[56] References Cited

UNITED STATES PATENTS

| | | | |
|---|---|---|---|
| 2,976,657 | 3/1961 | Cloud | 53/182 X |
| 3,024,581 | 3/1962 | Cloud | 53/182 X |
| 3,221,474 | 12/1965 | Hoffmann et al. | 53/182 |

*Primary Examiner*—Robert L. Spruill

*Attorney, Agent, or Firm*—Koenig, Senniger, Powers and Leavitt

[57] ABSTRACT

Packaging apparatus for packaging units in flexible sheet material with the units spaced longitudinally in a tube formed of the material and with the tube sealed together between successive units. The apparatus includes a rotary sealing wheel carrying a series of sealing assemblies for sealing the tube, the sealing assemblies being uncoupled from the wheel and held at a hold position for again being released in timed relation to movement of the tube for sealing the tube between successive units. The sealing assemblies are releasably coupled to opposite sides of the wheel, and in accordance with this invention an arrangement is provided for simultaneously uncoupling and coupling the sealing assemblies from both sides of the wheel.

6 Claims, 7 Drawing Figures

PACKAGING APPARATUS

BACKGROUND OF THE INVENTION

This invention relates to packaging apparatus, and more particularly to apparatus for packaging a product in a tubular bag having its ends sealed closed.

Specifically, this invention relates to an improvement of packaging apparatus as disclosed in U.S. Pat. No. 2,976,657 to Cloud in which a product to be packaged is placed on a web, and the web is formed into a tube around the product and sealed and severed in front of and behind the product to form a bag. In the above-mentioned Cloud patent, the entubed products pass around a so-called rotary turret or wheel. A plurality of clamping assemblies or die sealing units are held stationary in a rest or hold position at one location on the wheel with the wheel rotating relative to the sealing units when the latter are in their hold position. In timed-relation to movement of the portions of the tube between successive products therein, the sealing units are released one at a time from the hold position and are coupled to the wheel for being driven by the wheel. Each sealing unit has a fixed lower jaw and a hinged upper jaw swingable from an open to a closed position as the sealing unit moves from the hold position so as to clamp the tube between the jaws intermediate successive products in the tube. The jaws may be heated so as to heat-seal the tube, or may include other means to otherwise seal the tube transversely across the tube. Also, the jaws may carry a severing blade (or a heated wire) for severing the tube within the seal formed by the jaws thereby to form the trailing end seal of a leading bag and the leading end seal of a trailing bag. The jaws securely grip the web as the die moves with the wheel and thus pull the tube and products therein through the apparatus at the speed of the wheel. In the above-mentioned Cloud patent, sealing units are coupled to the wheel by means of a so-called clutch at one side of each sealing unit.

Other packaging apparatus similar to the above-described apparatus are known which have means for releasably coupling the sealing units to the wheel at both sides of the sealing units. However, in the apparatus shown in the above-mentioned U.S. Pat. No. 2,976,657 and in the above-mentioned similar apparatus, the coupling means sometimes causes the sealing units to cant or cock relative to the wheel which in turn results in an oblique seal being formed or in the jaws closing on a portion of the product. Furthermore, this canting or cocking of the sealing units may cause them to stick to the wheel thus preventing their release at the hold position and thus they may be forceably driven into the other sealing units at the rear of the hold position with possible consequent damage to the apparatus.

SUMMARY OF THE INVENTION

Among the several objects of this invention may be noted the provision of apparatus, such as above-described, which consistently forms end seals for packages being formed which are perpendicular to the sides of the packages; the provision of such apparatus in which the sealing units are reliably uncoupled from and coupled to both sides of the wheel simultaneously; and the provision of such apparatus which is of simple and rugged construction and which is reliable in operation at relatively high production speeds. Other objects and features of this invention will be in part apparent and in part pointed out hereinafter.

Briefly, apparatus of this invention packages units in flexible sheet material (e.g., heat-sealable plastic film) wherein the units are spaced longitudinally in a tube of the material. The apparatus includes means for sealing the tube between the units comprising a wheel having two sides rotatable on an axis. A series of sealing units or assemblies is carried by the wheel and each sealing unit has means for coupling it to the wheel at both sides thereof for travel with the wheel and is adapted for uncoupling the sealing unit from the wheel to allow the wheel to rotate while the sealing unit remains stationary. Means is provided for arresting a first sealing unit at a hold position and for actuating its coupling means to uncouple the sealing unit from the wheel. Successive sealing units trailing the first sealing unit are arrested by interengagement behind the arrested unit and the coupling means of these successive sealing units are actuated to uncouple the sealing units from the wheel by the above-mentioned interengagement. The arresting means comprises a pair of stops, one at each side of the wheel, movable between an operative position wherein they are engageable by the coupling means of the first sealing unit to arrest the first sealing unit and to uncouple it from both sides of the wheel and a retracted position for release of the sealing unit to travel with the wheel and to couple it to the wheel. A single actuator is provided for the two stops, and a linkage arrangement interconnects the actuator and the two stops for simultaneously releasing the first sealing unit from both sides of the wheel simultaneously coupling it to both sides of the wheel for travel of the sealing unit with the wheel upon operation of the actuator.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
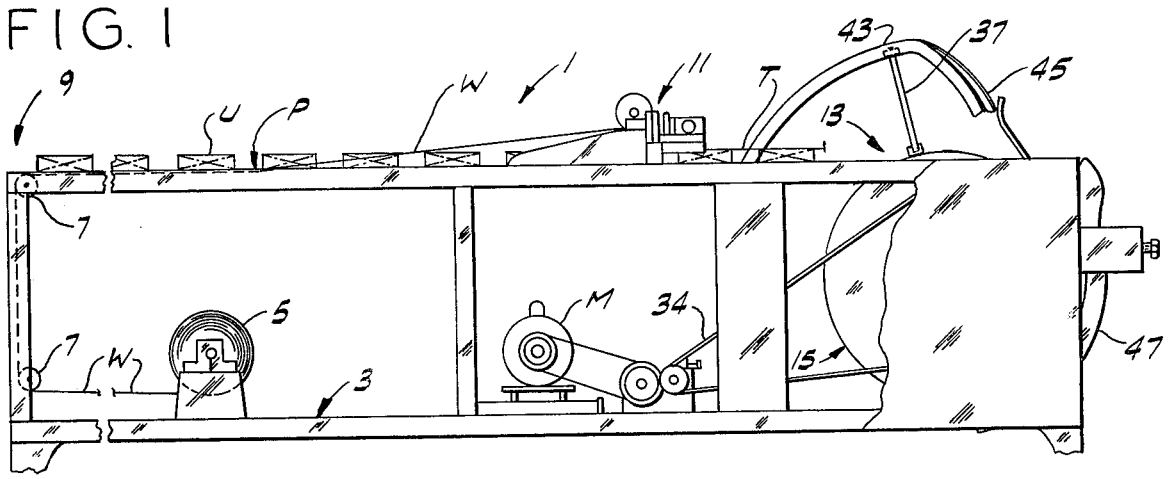
FIG. 1 is a simplified side elevational view of apparatus of this invention with parts broken away and with other parts omitted to illustrate key components of the apparatus.

Referring now to the drawings, packaging apparatus 1 of this invention is shown to comprise a frame 3 for supporting a roll 5 of flexible web material W, such as heat-sealable plastic film, heat-sealable laminated sheet material, or the like. The web travels over rollers 7 along a path P through the apparatus. More particularly, web W moves past a loading station 9 at which point units U are fed onto the upper face of the web at substantially equal longitudinal intervals along the web by an infeed conveyor (not shown). As indicated at 11, means is provided along the path P for forming the web into a tube T surrounding the units. This tube forming means folds up the side margins of the web on the units and forms a continuous longitudinal back seal joining the side margins of the web. The tube with the units U therein is moved along its path P toward means generally indicated at 13 for sealing and severing the tube between successive units U at package length intervals thereby to form a sealed bag around each unit.

Figure 2:
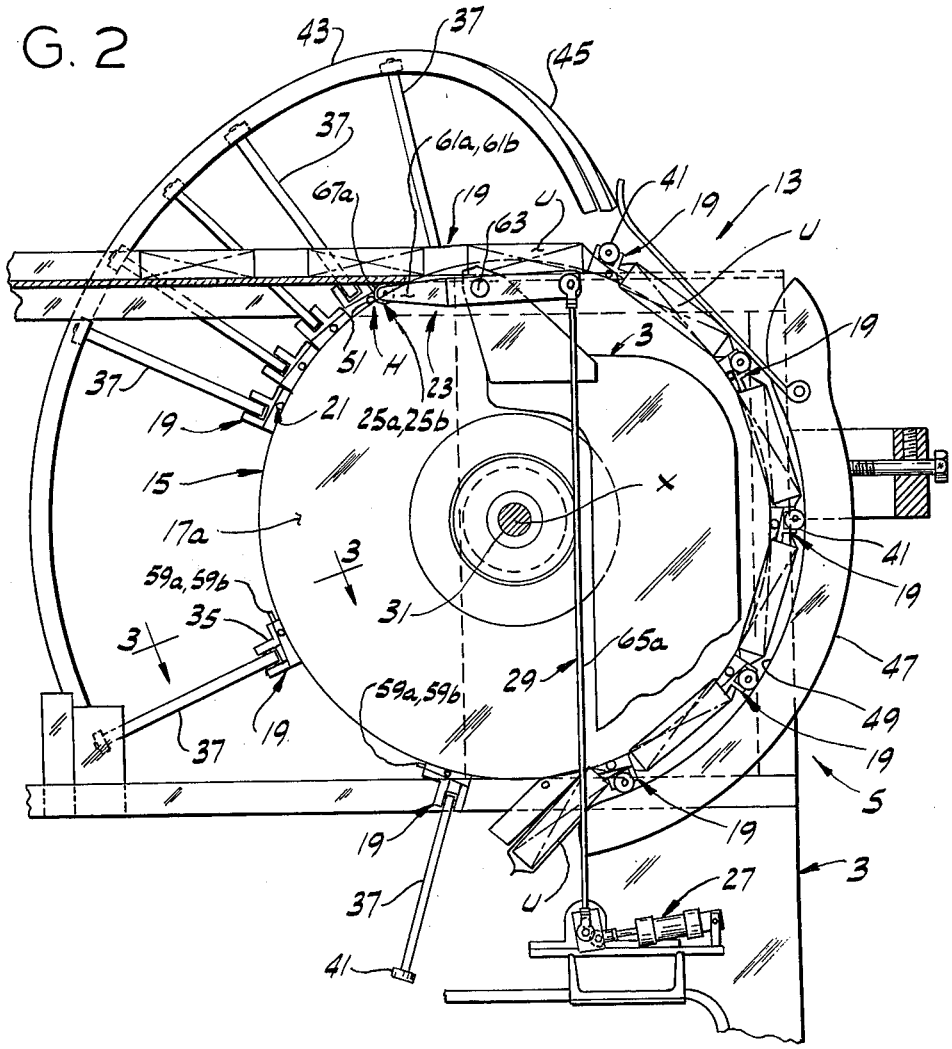
FIG. 2 is an enlarged view of a portion of the apparatus shown in FIG. 1 with some parts broken away illustrating a wheel, a series of sealing units carried by the wheel, and means for arresting a plurality of the sealing units at a hold position and for releasing the first sealing unit at the hold position to travel with the wheel.

More particularly, sealing means 13 comprises a wheel 15 rotatable on a horizontal axis X and having two spaced, circular side plates 17*a*, 17*b*. The sealing means further comprises a series of sealing assemblies or units, each sealing unit being indicated at 19, carried by the wheel. Each sealing unit 19 has means 21 (see FIGS. 2–5) for coupling it to both side plates 17*a*, 17*b* of wheel 15 for travel with the wheel and for uncoupling it from the wheel to allow the wheel to rotate relative to the sealing unit while the sealing unit remains stationary. As indicated at 23, means is provided for arresting a first sealing unit 19 at a hold position H and actuating its coupling means 21 to uncouple it from the wheel. Successive sealing units 19 trailing the first unit are arrested by interengagement behind the arrested unit, and the coupling means thereof are actuated to uncouple the successive sealing units from wheel 15. As shown in FIG. 2, arresting means 23 comprises a pair of stops 25*a*, 25*b*, one at each side of the wheel, movable between an operative position (as shown in FIG. 4) wherein the stops are engageable by coupling means 21 of the first sealing unit at hold position H to simultaneously uncouple this first sealing unit from both side plates 17*a*, 17*b* of wheel 15 and a retracted position (see FIG. 5) for release of the sealing unit to travel with the wheel and for simultaneously coupling it to both sides of the wheel. A single cylinder actuator unit 27 is provided for stops 25*a*, 25*b*, and a linkage arrangement, generally indicated at 29, interconnects actuator cylinder unit 27 and stops 25*a*, 25*b* for simultaneous movement of the stops between their operative and retracted positions.

More particularly, wheel plates 17*a*, 17*b* are spaced apart a distance somewhat greater than the maximum width of units U which can be packaged by apparatus 1. The plates are secured to a shaft 31 which is journalled by frame 3. Each side plate has a respective groove 33*a*, 33*b* in its inner face adjacent its periphery (see FIG. 3). Wheel 15 is rotatably driven by a motor M via a chain and sprocket drive assembly 34.

Figure 3:
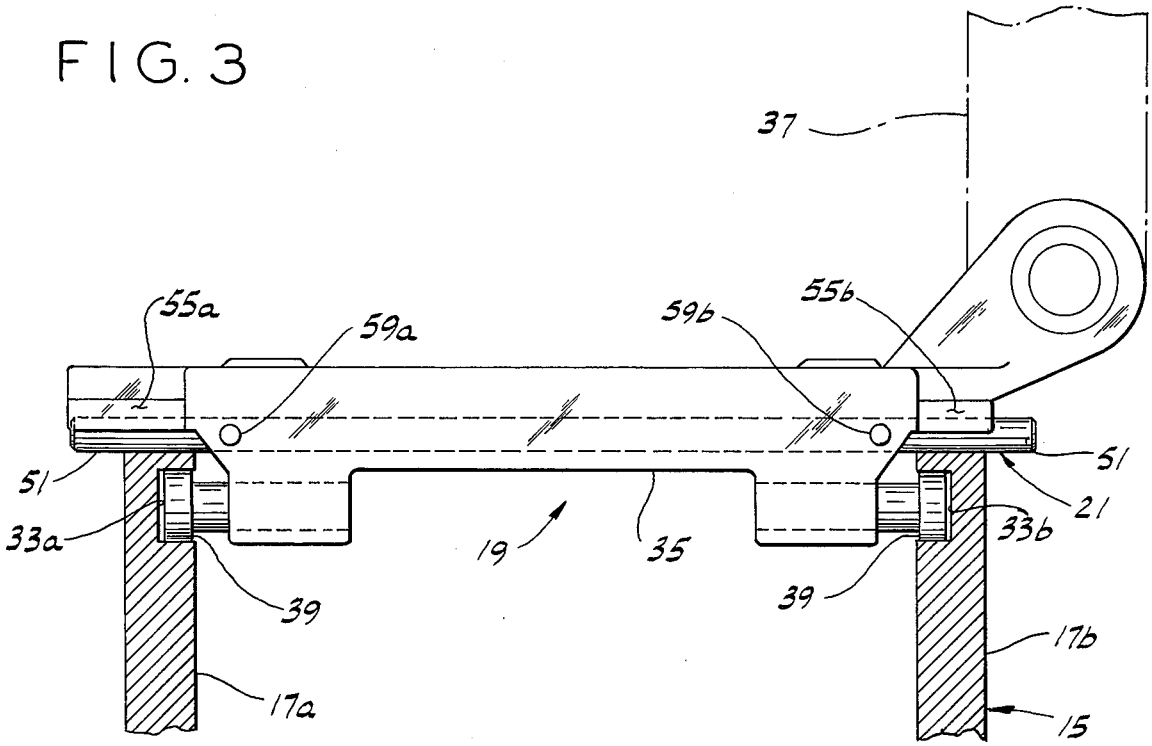
FIG. 3 is an enlarged vertical cross section taken on line 3—3 of FIG. 2 illustrating a sealing unit with its upper jaw (shown in phantom) in a raised or open position.
Figure 4:
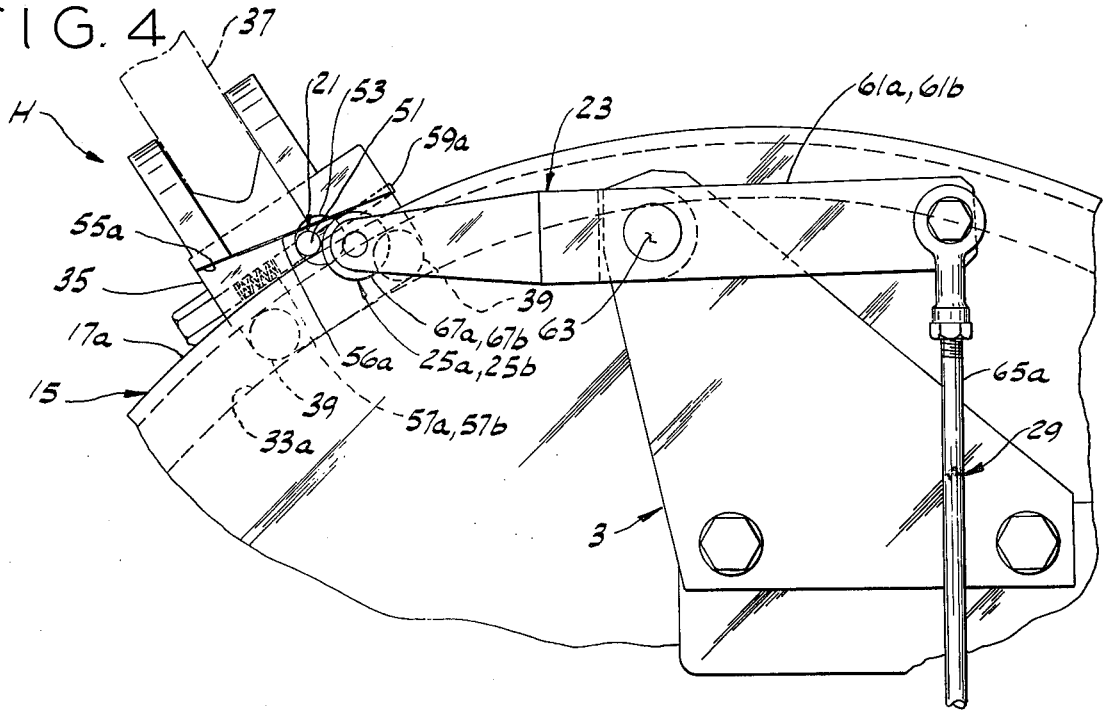
FIG. 4 is an enlarged view of a portion of the apparatus shown in FIG. 2 illustrating the arresting means in its operative position.
Figure 5:
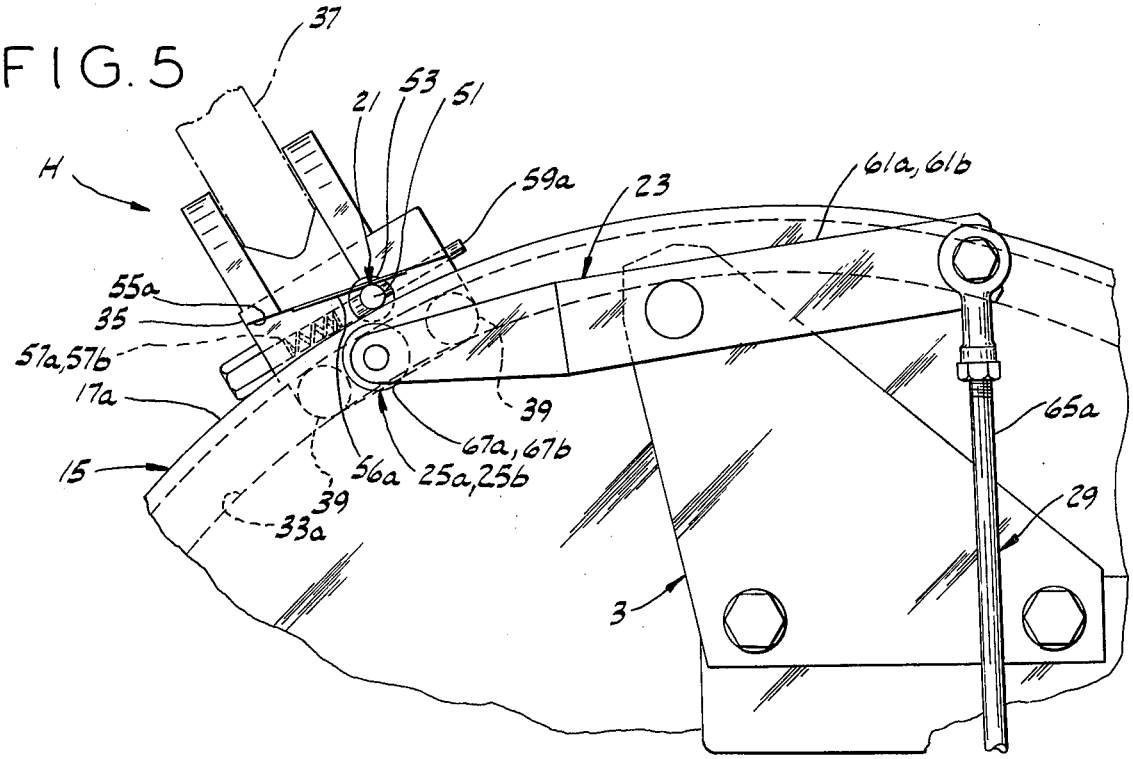
FIG. 5 is a view similar to FIG. 4 illustrating the arresting means in its retracted position.

As shown in FIGS. 3–5, each sealing unit 19 includes a base 35 extending laterally between and beyond wheel plates 17*a*, 17*b*, this base constituting a fixed or lower sealing jaw and hingedly carrying an upper sealing jaw 37 swingable between an open position (e.g., the position of the upper jaws of sealing units 19 in hold position H) and a closed position (e.g., the position of the upper jaws of sealing units at the right side of wheel 15 in FIG. 2) in which the jaws clamp tube T therebetween. As disclosed in the heretofore-mentioned U.S. Pat. No. 2,976,657, the jaws may be heated for heat-sealing the tube and may carry blades (not shown) for severing the tube between successive units U. With the jaws closed and clamped to the tube and with the sealing units positively coupled to the wheel 15, the sealing units pull web W and tube T along path P through the apparatus as the sealing units rotate with the wheel through a sealing zone S. As shown in FIG. 2, more than one sealing unit grips the tube at any one time and thus the tube is continuously conveyed along its path P at substantially the surface speed of the sealing units carried by wheel 15.

More particularly, base 35 of each sealing unit 15 has a pair of rollers at each side thereof, each of these rollers being indicated at 39, received in grooves 33*a*, 33*b* in wheel plates 17*a*, 17*b*. These rollers transmit substantial clamping forces from the base to wheel 15 as sealing units 19 pass through sealing zone S and also permit movement of wheel 15 relative to the sealing units when the latter are arrested at hold position H. A cam roller 41 (see FIG. 2) is carried by the outer end of movable jaw 37. These rollers are received in a guide track 43 when sealing units 19 are in their hold position to hold the jaws open. The guide track has a cam closing portion 45 which closes the jaws of each sealing unit as the latter is released from hold position H and as it travels with the wheel toward sealing zone S. An arc-shaped pressure cam 47 is spaced from the outer periphery of wheel 15 and extends around a portion of the wheel. The length of pressure cam 47 generally defines sealing zone S. The pressure cam has a cam surface 49 engageable with cam rollers 41 to firmly hold jaw 37 closed on its fixed jaw 35 thereby to positively grip tube T and to seal the tube as heretofore described. Upon exiting the pressure cam, the upper jaw is swung open by gravity (see FIG. 2) and the packaged unit U drops free of wheel 15 onto an outfeed conveyor (not shown).

As shown in FIGS. 3–5, each sealing unit base 35 has a coupling bar 51 extending laterally of the sealing unit out beyond the lateral ends of the sealing unit and beyond side plates 17*a*, 17*b* of wheel 15. This coupling bar is received within an enlarged bore 53 in base 35. At each side of base 35 an inclined ramp 55*a*, 55*b* is spaced radially outwardly of the outer peripheral surface of wheel plates 17*a*, 17*b* with the end of this inclined ramp surface toward the direction of movement of wheel 15 being spaced from the outer periphery of the wheel a distance somewhat less than the thickness of coupling bar 51. A resilient flat spring 56*a* or 56*b* is provided on the downwardly facing surface of respective ramps 55*a* and 55*b* for resiliently biasing the coupling bar into engagement with the outer peripheral surfaces of wheel side plates 17*a*, 17*b*. Compression coil springs 57*a*, 57*b* at opposite lateral ends of base 35 bias coupling bar 51 in the direction of rotation of the wheel toward a coupling position (see FIG. 5) in which the coupling bar is wedged between the outer peripheral surfaces of wheel plates 17*a*, 17*b* and springs 56*a*, 56*b* thereby to lock the sealing unit to the wheel. The coupling bar is movable against the bias of springs 57*a*, 57*b* to an uncoupled position in which the coupling bar is clear of the peripheral surfaces of wheel plates 17*a*, 17*b* thereby to uncouple the sealing unit from the wheel. Coupling bar 51 carries a pair of interengagement pins 59*a*, 59*b* which are received in apertures in base 35 and which project out beyond the forward end of the base for interengagement with a previously arrested sealing unit 19 at hold position H as the sealing unit enters the hold station. Upon interengagement, pins 59*a*, 59*b* move coupling bar 51 from its coupled to its uncoupled position thereby to effect uncoupling of the sealing unit upon interengagement with the next successive unit in the hold position.

More particularly, arresting means 23 comprises a rocker arm 61*a* or 61*b* on each side of wheel 15 pivoted intermediate its ends to frame 3 by a pivot pin 63 carried by the frame. Each rocker arm 61*a*, 61*b* has a respective elongate link or rod 65*a*, 65*b* pivotally connected to one of its ends and it carries a cam roller 67*a* or 67*b* on its other end. These cam rollers constitute stops 25*a*, 25*b*. When rocker arms 61*a*, 61*b* are in a raised position (as shown in FIGS. 2 and 4) the stops (i.e., cam rollers 67*a*, 67*b*) are in their above-stated operative positions and are engageable by the outer ends of coupling bar 51 of the first sealing unit 19 at hold position H. As best shown in FIG. 4, cam rollers 67*a*, 67*b* are adapted to be engaged by the coupling bar above the rotary axis of the cam rollers when the rocker arms are in their operative position (as shown in FIGS. 2 and 4). This insures that the cam rollers may readily be moved downwardly to their retracted position. Each sealing unit 19 includes brake means (not shown) frictionally engageable with wheel 15 for preventing the sealing unit from moving from the top of the wheel toward sealing zone S at a speed greater than the rotational speed of the wheel. Thus, wheel 15 applies a force to the sealing units via the abovementioned brake means and via rollers 39 idling in grooves 33*a*, 33*b* to urge sealing units 19 at hold position H in the direction of rotation of the wheel. With coupling rod 51 of the first sealing unit in the series of sealing units at hold station H in engagement with cam rollers 67*a* and 67*b* above the center thereof, the force transmitted to rocker arms 61*a*, 61*b* by the sealing units in the hold position causes cam rollers 67*a*, 67*b* to move downwardly and thus causes the rocker arms to place their respective rods 65*a*, 65*b* under tension loading.

Figure 6:
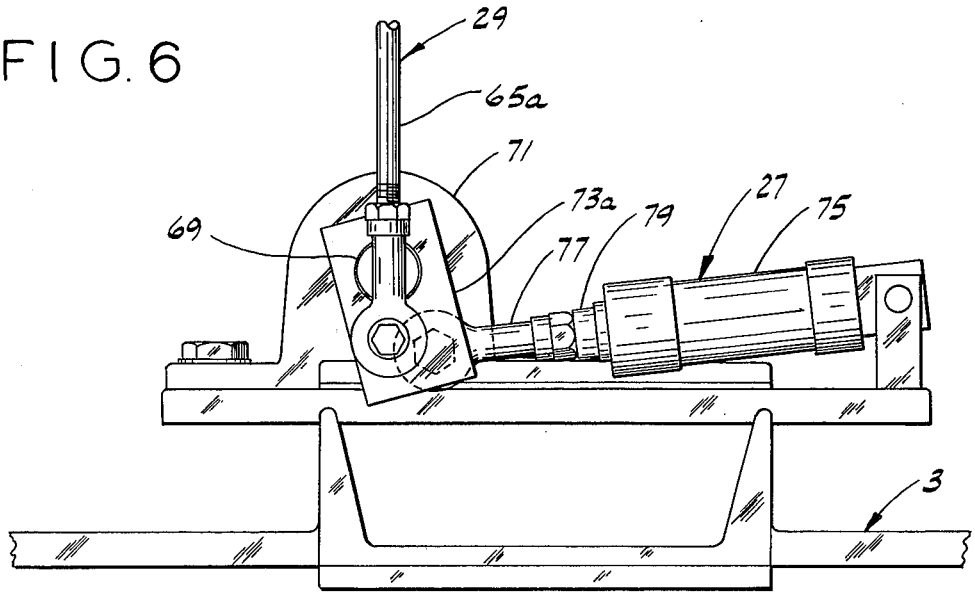
FIG. 6 is an enlarged side elevational view of an actuator for the arresting means.
Figure 7:
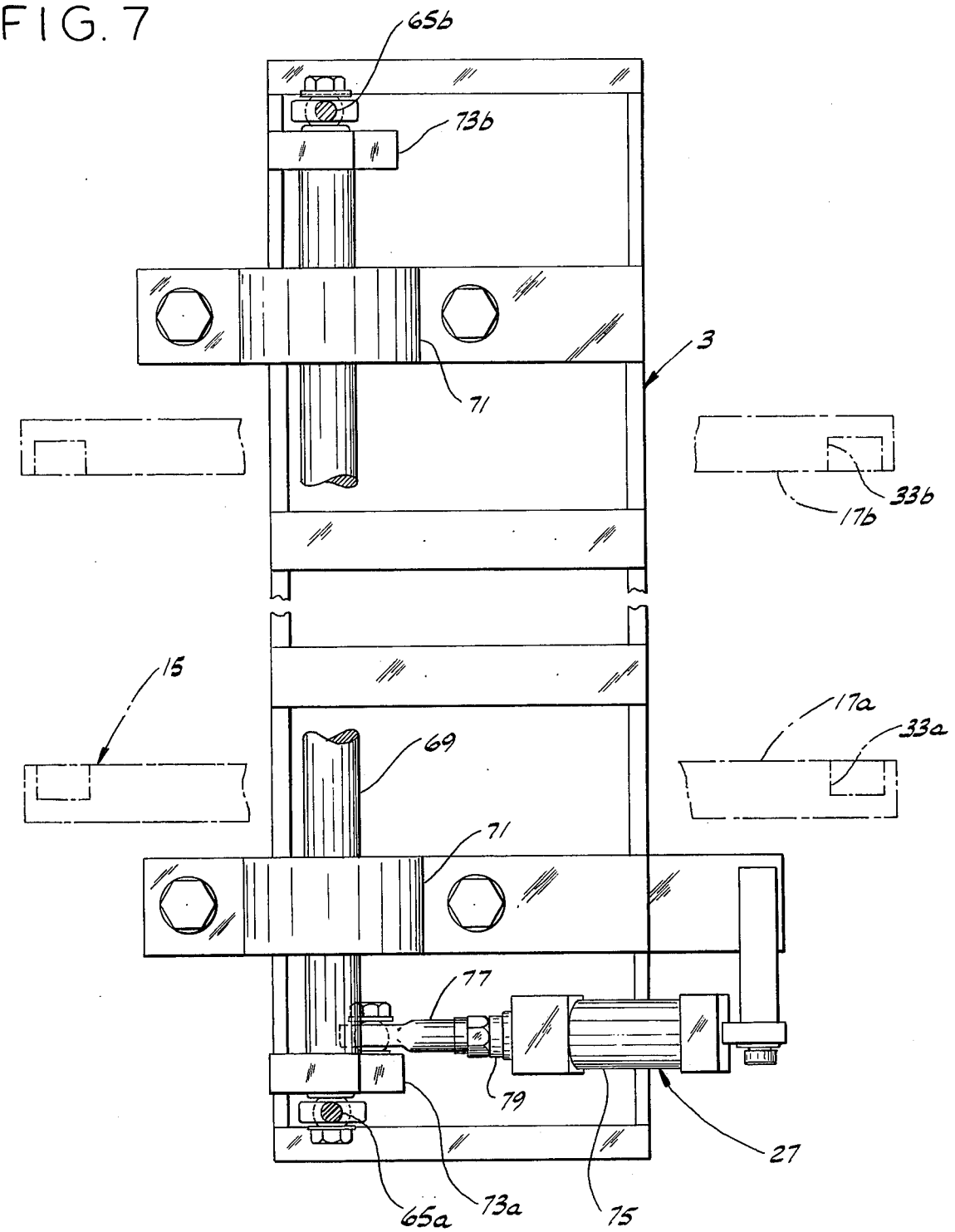
FIG. 7 is a plan view of the actuator.

Linkage 29 further comprises a horizontal crankshaft 69 (see FIG. 7) journalled in bearings 71 secured to frame 3. This crankshaft extends beyond the sides of wheel 15 and has crank arms 73*a*, 73*b* fixedly secured to its outer ends. The lower ends of rods 65*a*, 65*b* are pivotally secured to the outer face of a respective crank arm 73*a*, 73*b* offset from the center of crankshaft 69. Actuator cylinder 27 is shown to be an air cylinder having a cylinder body 75 which is pivotally secured to frame 3 and a piston and piston rod assembly 77 axially movable within the cylinder between an actuated position (not shown) in which the piston and piston rod assembly is moved outwardly relative to the cylinder body and an unactuated or retracted position (see FIG. 6) in which the piston and piston rod assembly is retracted into the cylinder body. The free end of the piston rod is pivotally connected to the inside face of crank arm 73*a* and is spaced laterally from the connection of the lower end of rod 65*a* to the crank arm. Cylinder body 75 has a stop 79 engageable by piston and piston rod assembly 77 to prevent inward movement of the latter into the cylinder beyond a predetermined location. With rocker arms 61*a*, 61*b* in their operative positions, it will be noted that the lower ends of rods 65*a*, 65*b* are directly below the axis of crankshaft 69 and preferably on the side of the crankshaft toward actuator cylinder unit 27 so that the tension loading of rods 61*a*, 61*b* (as heretofore described) biases the piston and piston rod assembly 77 into body 75. Thus, the arrangement of rods 65*a*, 65*b*, piston rod assembly 77 on crank arms 73*a*, 73*b*, and stop 79 constitutes overcenter locking means for preventing movement of stops 25*a* and 25*b* from their operative position. Upon pressurization or energization of actuator cylinder 27, crankshaft 69 rotates in clockwise direction (as viewed in FIG. 6) and thus causes rocker arms 61*a*, 61*b* to simultaneously rotate in counterclockwise direction to effect movement of stops 25*a*, 25*b* (i.e., cam rollers 67*a*, 67 *b*) from their operative to their retracted position thereby to release coupling bar 51 of the first sealing unit 19 at hold station H and thus to permit the coupling bar to move from its uncoupled to its coupled position for coupling the sealing unit to wheel 15 for effecting travel of the sealing unit with the wheel. Shortly after coupling bar 51 moves past cam rollers 67*a*, 67*b*, actuator cylinder 27 is actuated in reverse direction to return rocker arms 61*a*, 61*b* and their cam rollers 67*a*, 67*b* to their respective operative positions in which they are in position for engagement by the coupling bar 51 of the next successive sealing units 19 in the series of sealing units at hold position H. It will be noted that with a single actuator cylinder 27 and with linkage 29, stops 25*a*, 25*b* are simultaneously retracted from the coupling bar 51 of the first sealing unit at both sides of wheel 15 thereby to insure that both sides of the sealing unit are simultaneously coupled to the wheel. This prevents one side of the sealing unit from being coupled to the wheel before its other side and thus eliminates canting or cocking of the sealing units relative to the wheel.

It will be understood that actuator cylinder 27 is actuated by a solenoid valve (not shown) under the control of a photoelectric control system (also not shown) which senses units U in tube T or senses registration marks printed on web W and which releases sealing units 19 from hold station H in timed relation to movement of tube T and units U therein. Since this photoelectric control system is described in the abovementioned U.S. Pat. No. 2,976,657 and since these systems are well known in the art, a detailed description of them is deemed unnecessary to the understanding of the present invention.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for packaging units in flexible sheet material wherein the units are spaced longitudinally in a tube of said material and the apparatus has means for sealing the tube between the units, said sealing means comprising:

a wheel rotatable on an axis and having two sides;

a series of sealing units carried by the wheel;

each sealing unit having means for coupling it to the wheel at both sides thereof for travel therewith and adapted for uncoupling of the sealing unit from the wheel to allow the wheel to rotate while the sealing unit remains stationary;

means for arresting a first sealing unit at a hold position and for actuating its coupling means to uncouple said sealing unit from the wheel;

successive sealing units trailing said first sealing unit being arrested by interengagement behind said arrested unit, and the coupling means thereof being actuated to uncouple said sealing units from the wheel by said interengagement;

said arresting means comprising a pair of stops, one at each side of the wheel, movable between an operative position wherein they are engageable by said coupling means of said first sealing unit to arrest said first sealing unit and to uncouple it from both sides of the wheel and a retracted position for release of said sealing unit to travel with the wheel and to couple it to the wheel;

a single actuator for the two stops; and a linkage interconnecting said actuator and said two stops for simultaneously releasing said first sealing unit from both sides of the wheel and simultaneously coupling it to both sides of the wheel for travel of the sealing unit with the wheel upon operation of said actuator.

2. Apparatus as set forth in claim 1 wherein said single actuator is a fluid cylinder unit, and wherein said linkage comprises a crankshaft generally parallel to said wheel axis extending beyond the sides of the wheel, a crank arm secured to said crankshaft adjacent each end thereof beyond the sides of the wheel, and a link interconnecting the crank arm and the stop at each side of the wheel for simultaneous movement of the stops between their operative and retracted positions upon actuation of said fluid cylinder unit.

3. Apparatus as set forth in claim 2 wherein each said stop is a rocker arm pivoted intermediate its ends having its respective said link pivotally connected to one of its ends for rocking said rocker arm on its pivot between said operative position in which its other end is disposed for engagement by said coupling means of said first sealing unit for arresting the latter at said hold position and said retracted position in which its said other end is clear of said coupling means.

4. Apparatus as set forth in claim 3 further comprising a cam roller carried by said other end of said rocker arm engageable by said coupling means.

5. Apparatus as set forth in claim 3 wherein said wheel urges said sealing units at said hold position in the direction of rotation of said wheel, said other end of said rocker arm holding said sealing units in said hold position against the urging of said wheel, and wherein said apparatus further comprises means for locking said rocker arms in their operative position, said fluid cylinder unit unlocking said rocker arms upon actuation of the fluid cylinder unit.

6. Apparatus as set forth in claim 5 wherein said fluid cylinder unit has a cylinder body, a piston and piston rod assembly movable axially within said body, and a stop for preventing movement of said piston and piston rod assembly in one direction beyond a predetermined point relative to the body, and wherein with said rocker arms in their operative position, said other ends of said rocker arms holding said first sealing unit at said hold position, said stop, said fluid cylinder unit, and said linkage constituting said means for locking said rocker arms in their operative position.

* * * * *